United States Patent [19]

Schwan

[11] 4,314,685

[45] Feb. 9, 1982

[54] DEVICE FOR MOUNTING A SHELF ON A COLUMN

[76] Inventor: Erich Schwan, Wecholder Str. 136, D-2800 Bremen 61, Fed. Rep. of Germany

[21] Appl. No.: 39,519

[22] Filed: May 16, 1979

[30] Foreign Application Priority Data

May 17, 1978 [DE] Fed. Rep. of Germany ..... 2821470

[51] Int. Cl.[3] ..... A47B 57/04; A47B 57/20; A47B 57/24

[52] U.S. Cl. ..... 248/242; 108/6; 108/107; 248/223.4

[58] Field of Search ..... 248/242, 291, 223.4; 108/6, 107, 109

[56] References Cited

U.S. PATENT DOCUMENTS 3,700,114 10/1972 Myers ..... 248/242 X 3,795,379 3/1974 Gray ..... 248/242

FOREIGN PATENT DOCUMENTS 659343 3/1963 Canada ..... 248/342

2501349 7/1976 Fed. Rep. of Germany ..... 248/342

1232330 10/1960 France ..... 108/6

*Primary Examiner*—William E. Lyddane

*Attorney, Agent, or Firm*—Trexler, Bushnell & Wolters, Ltd.

[57] ABSTRACT

A merchandise base, such as a shelf, is mounted on a supporting column by a device having pins or the like received in vertically spaced holes or recesses in the column. The pins are interconnected by a plate, and at least the upper pin has a radially enlarged head. Both pins interfit with a bracket on the base and the enlarged head secures the bracket against movement away from the column.

12 Claims, 21 Drawing Figures

Fig.5
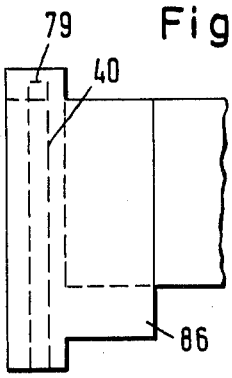
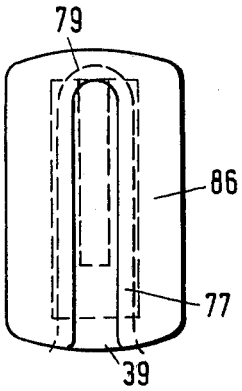
Fig.6
Fig.4
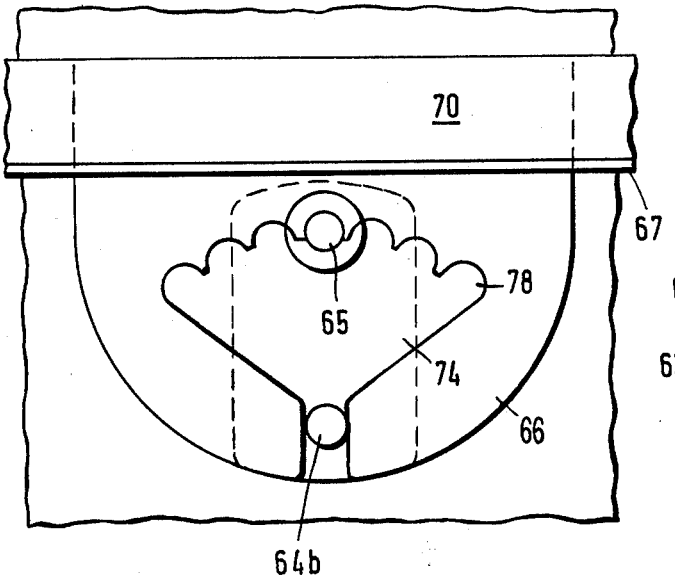
Fig.3
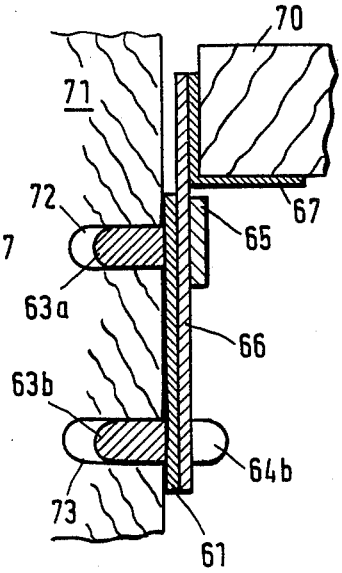
Fig.2
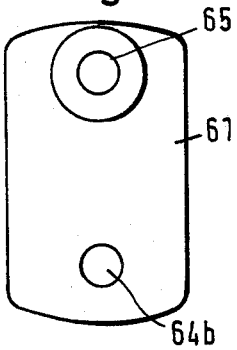
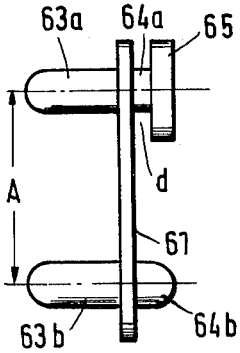
Fig.1

Fig.9
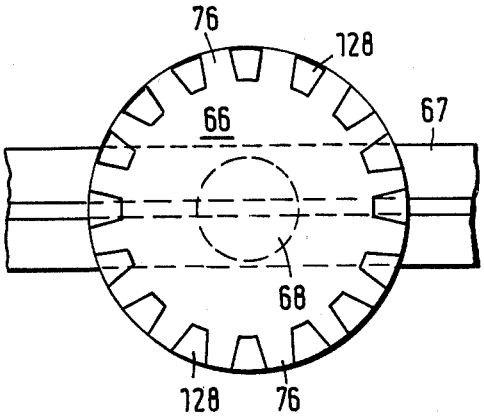
Fig.10
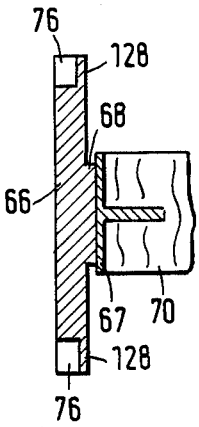
Fig.12
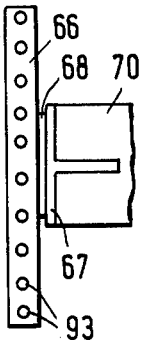
Fig.7
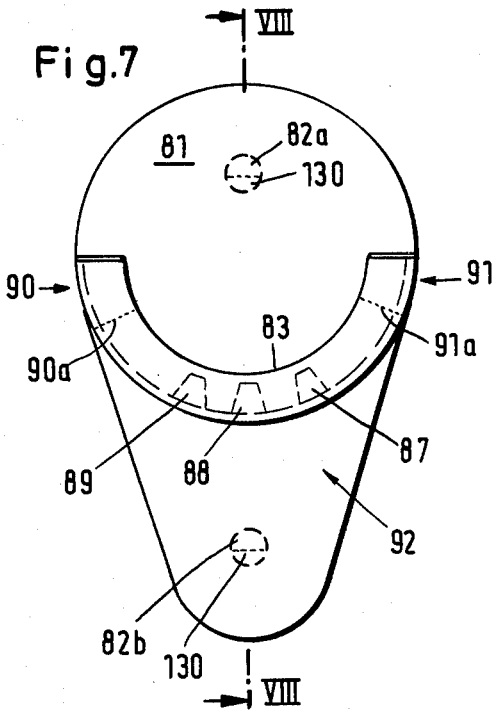
Fig.8
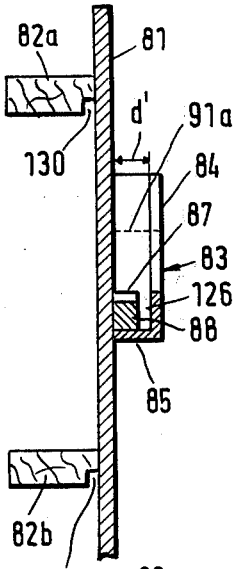
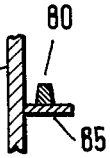
Fig.11

DEVICE FOR MOUNTING A SHELF ON A COLUMN

The invention relates to a device consisting of a connection plate and a carrier element for the detachable anchoring of a merchandise base or a similar merchandise repository on a column, which has recesses, of and indoor furnishing system—with pins, hooks or the like, which fit the recesses, protruding from the connection plate on one side and with at least one support part for an outer support constructed on the carrier element protruding from the opposite side.

On the indoor furnishing system described in the German Disclosure paper No. 2 501 349, the support part consists of a pair of pins arranged vertical one above the other. In the carrier element there are constructed as outer supports either a vertical longitudinal groove or guide slots in connection with circular cutouts into which the pins can engage. During the assembly of the indoor furnishing system the merchandise base, which is provided on both ends with one carrier element each is put on the pins from above.

If the merchandise base is loaded heavily or if it exceeds a certain length, it has a tendency to bend with the consequence that axially working forces are exerted on the connection plate. These forces act in the upper zone as traction forces which point away from the column and, if sufficiently great, can cause loosening or detachment of the support of the carrier element on the connection plate.

The aim of the invention is an improvement of the well-known device on which means shall be provided which prevent the detachment of the load bearing seat of the carrier element on the connection plate even with a heavy load on the merchandise repository.

For this purpose the device mentioned in the beginning is developed further by the fact that on the connection plate there is provided in the upper zone an axially acting locking device which extends at least partly in a direction parallel to the surface of the connection plate and that on the carrier element an edge protrudes radially in order to engage in the locking device.

The invention permits also an abnormally heavy loading of the merchandise base without the carrier element being able to detach from the connection plate under the influence of occurring tilting moments. Thereby not only the support capacity of the indoor furnishing system is increased but the appearance is also improved because the merchandise base can sag considerably less under load.

Further development of the invention are evident from the following description of several embodiments of the invention with reference being made to the attached drawings. Individually, FIG. 1 shows a lateral view of a connection plate;

FIG. 2 shows a front view of a connection plate;

FIG. 3 shows a view of a vertical cut of a connection plate with the carrier elements suspended according to FIG. 1;

FIG. 4 shows a front view of the connection plate with carrier element according to FIG. 3;

FIG. 5 shows a lateral view of another embodiment of a carrier element;

FIG. 6 shows a rear view of the carrier element according to FIG. 5;

FIG. 7 shows a top view on another embodiment of a connection plate;

FIG. 8 shows a cut through the connection plate according to FIG. 7 along line VIII—VIII;

FIG. 9 shows a front view of a carrier element suitable for the connection plate according to FIG. 7;

FIG. 10 shows a lateral view of the carrier element according to FIG. 9 with merchandise base;

FIG. 11 shows a cutout from FIG. 8 concerning a modified connection plate;

FIG. 12 shows a view—resembling FIG. 10—of a carrier element fitting for the connection plate according to FIG. 11;

Figure 14:
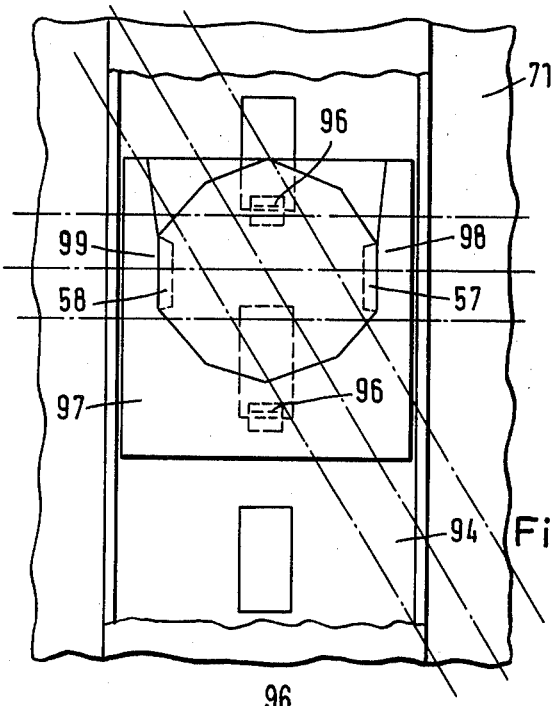
FIG. 14 shows a front view of the assembled device according to FIG. 13.

The invention is a further development of an indoor furnishing system according to the German Disclosure Paper No. 2 501 349 as well as according to the German Disclosure Paper No. 2 739 147 so that reference is made to the description in the paper mentioned first in order to avoid repititions. Thus the embodiments according to FIG. 1 to 6 are shown on connection plates and carrier elements which are illustrated in FIG. 2, 4 and 5 of the paper mentioned first.

The connection plate 61 has essentially a rectangular outline and has two pairs of pins 63*a*, 63*b* and 64*a*, 64*b*. The pair of pins 63*a*, 63*b* is welded onto the back side of the connection plate 61 or fastened in a different manner and is arranged at a predetermined distance A in the longitudinal axis of the connection plate. The pair of pins 64*a*, 64*b* is fastened on the front side of the connection plate 61 essentially at the same spots where the pair of pins 63*a*, 63*b* is fastened on the back side of the connection plate 61. As illustrated, the back pair of pins 63*a*, 63*b* is longer than the front pair of pins 64*a*, 64*b*. The pins 63*a*, 64*a* and the pins 63*b* 64*b* can each consist of a one-piece peg which is anchored in a passage hole of the connection plate 61.

As defined in the invention, the end of the front pin 64*a*, which points away from the front side of the connection plate, is widened radially to a disk 65. Between the disk 65 and the connection plate 61, there is left a space d in which a carrier element 66 (FIG. 3) can engage vertically. Additionally, the end of the pin 64*b*, which points away from the connection plate 61, can also be provided with a similar disk.

The lateral view of an axial vertical cut—illustrated in FIG. 3—of the assembled device as defined in the invention shows dummy holes 72, 73 which are drilled into the column consisting perhaps of wood and into which the connection plate 61 with the pair of pins 63*a*, 63*b* is put from the outside. The axes of the dummy holes 72, 73 have the distance A; they are drilled slightly deeper than the length of the pins 63*a*, 63*b* and have an inside diameter which is equal to the outside diameter of pins 63*a*, 63*b*.

The disk-shaped carrier element 66 is suspended in the connection plate in such a way that the upper edge of the recess 74 reaches behind the disk 65 at the end of the upper pin 64*a*. The edge, which limits the recess 74 on top, is chamfered semicircularly as shown in FIG. 4 so that the pin 64*a* can be caught in each of the grooves 78 located adjacent to each other. Since the diameter of the disk 65 is larger than the diameter of the pin 64*a*, the carrier element 66 remains arrested in each of the inclined positions in an axial direction, i.e. in a direction vertical to the viewing plane of the Figure.

In an upper extention the carrier element, as it is known per se, carries a mounting bracket 67 on whose free side, which points away from the column 71, the plate of the merchandise base 70 is put, screwed on or fastened in any other manner.

If the merchandise base 70 is loaded too much, a clockwise torque occurs around the lower edge of the carrier element 66. The disk 65 catches the carrier element 66 at the connection plate 61 so that the axial force effective because of the load is absorbed, on the one hand, by the merchandise base 70 and, on the other hand, by the anchoring of the connection plate 61 in the column 71. In this manner, the merchandise base 70 is held in a horizontal position even in case of a heavy load.

The carrier element 86 illustrated in FIG. 5 and 6 is an improvement of the carrier element which is shownin FIG. 4*a–c* of the German Disclosure Paper No. 2 501 349 and is described there. As defined in the invention, the bottom 40 of the slot 39 is widened by a circumferential groove 79 in such a way that the disk 65 can be held by the groove 79. The groove 39 is limited by a circular edge 77 behind which the disk 65 reaches, after the carrier element 86 has been placed on the connection plate 61. By this design of the carrier element there results an axially firm seat of said element on the connection plate 61.

The connection plate 81 according to FIG. 7 has the outline of a reversed drop (as of water or other liquid) and has a pair of pins 82*a*, 82*b* which extend away from the back side and can be placed in dummy holes 72, 73 of the column 71. On the front side, there protrudes a circular rim, which has an L-shaped profile and whose free side 84, which points into the inside of the semicircle, extends parallel to the front surface of the connection plate 81 at a distance d' which is yet to be explained. The base 85 of the rim 83 connected with the front side of the connection plate 81 carries on the lowest spots of its inner side three teeth 87, 88, 89 in an arrangement which is symmetrical to the vertical. The teeth rise upward from the bottom of the base 85; they have a trapezoidal cross section and fill the inner width of the rim 83 entirely except for a front section 126.

The carrier element 66 consists of a disk with outer teeth 76 whose spacing is such that the outer teeth 76 fit slipless between the teeth 87, 88, 89 (FIG. 9, 10) of the rim 83. The carrier element 66 is fastened by way of a spacer 68 on the mounting bracket 67 which is constructed in this example as a T rail and carries the merchandise base. The thickness of the carrier element 66 is essentially equal to the distance d' between side 84 and the front side of the connection plate 81; and the thickness of the distance piece 68 is greater than the wall thickness of the side 84. Therefore the carrier element 66 with support bracket 67 and merchandise base 70 can be hung into the rim 83 and can be fixed at any slant around an axis, which goes through the center of the rim circle, by the engaging of the outer teeth 76 with the teeth 87, 88, 89. The outer teeth 76 remain covered behind flange 128 going around an edge of the periphery—pointing to the merchandise base 70—of the carrier element 70; said flange has the same height as the outer teeth and a somewhat similar thickness than the width of the section 126.

If on this embodiment the side 84 is eliminated there results a device which can be produced considerably cheaper compared to the arrangement described in the application No. P 27 39 147.5—without the universality with respect to the selectable and adjustable angle of tilt being lost. The carrier element 66 can be, for instance, a commercial toothed wheel and the teeth 87, 88, 89 with base 83 can also be produced very easily by the use of prefabricated construction elements.

By means of side 84, this embodiment of the invention makes possible the axial fixation of the carrier element 66 on the connection plate 81 even with a heavy load on the merchandise base 70 without impairment of the possibility to select the angle of tilt of the merchandise base 70.

In place of a continuous semicircular rim 83 one can, if ncessary, limit himself to three separate sections 90, 91, 92 which are arranged along a circular periphery, section 92 of which—as the lowest section without side 84—carries the teeth 87, 88, 89. The sections 90 and 91 can then be limited at the edges 90*a* and 91*a* indicated by dotted lines.

The cutout from FIG. 8 illustrated in FIG. 11 shows the use of a mandrel 80, which runs conically upward, in place of the tooth 88 which is arranged in the center of the base 85. Teeth 87 and 89 have been omitted. Likewise side 84 is missing and merely the angle sections 90, 91 are provided as a safeguard against tilting of the inserted carrier element 66. The latter has according to FIG. 12 no outer teeth on the smooth circumference but in place of them it is provided with bores 93 which permit the carrier element 66 to be put on the mandrel 80 at a selectable tilt of the merchandise base. Otherwise this embodiment of the invention corresponds to the embodiment illustrated in FIG. 7–10.

The embodiment of the invention according to FIG. 13 to 16 is characterized by the fact that the connection plate 61 has on its front side a polygonal recess 100 which does not hold the entire thickness and is open toward the top, that the carrier element consists of a block with a polygonal outline and that the connection plate can be hung into a U rail embedded in the column. The U rail 94, which is embedded over the entire height of the column in the side pointing in the longitudinal direction of the merchandise base 70, has on its back side several holes 95 which are arranged one above the other evenly spaced in one row and into which angle hooks, which are constructed on the back side of the connection plate 61, can be hung. Since, with the connection plate 61 hung in, every angle hook 96 reaches behind the lower edge of each hole 95, the suspended connection plate 61 is safeguarded against axial movement in the U rail 94. With use of the connection plate 81 according to FIG. 7 and 8, there results the same effect if each pin 82*a*, 82*b* is provided directly on the back side of the connection plate 81 with an undercut 130 on the lower section of the circumference.

The connection plate 61 carries on the front side a bearing part 97 which is constructed as a step bearing and whose inside bearing surface has a polygon profile. Ribs 57, 58 protrude at least from the vertical bearing surfaces 98, 99 at a distance from the front side of the connection plate 61.

The bearing element has a polygonal outline with the individual polygon faces having the same size as the pertaining bearing surfaces of the bearing part 97. The bearing element 66 has a circumferential groove 59 into which ribs 57, 58 engage.

Through the circumferential groove there is constructed on the back side of the bearing element a circular peripheral radially protruding strip 56 which after the insertion of the bearing element 66 in the bearing part 97 reaches behind the ribs 57, 58 under any angle. Since the strip 56 itself consists of several polygonal sections, two sections of the strip 56, which are opposite each other, reach behind the ribs 57, 58 located opposite each other. In FIG. 14, two angle positions of the bearing element 66 are drawn by a dash-point indication of the mounting bracket. In one position the mounting bracket, which is inserted in a front recess 55 of the bearing element 66, is tilted downward to the right. In both positions several sections of the strip 56 on the bearing element 66, which are opposite each other each time, reach behind the ribs 57, 58 which are opposite each other.

Figure 15:
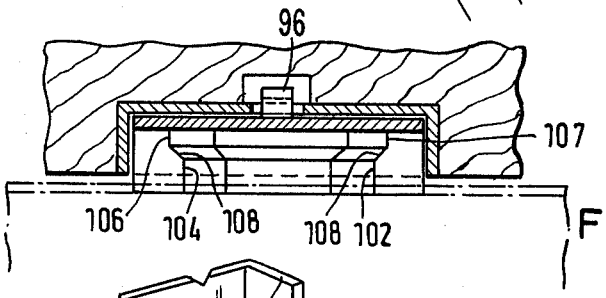
FIG. 15 shows a cross section through a device as defined in the invention with another modification.
Figure 16:
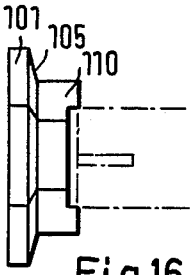
FIG. 16 shows a lateral view of the carrier element according to FIG. 15.
Figure 13:
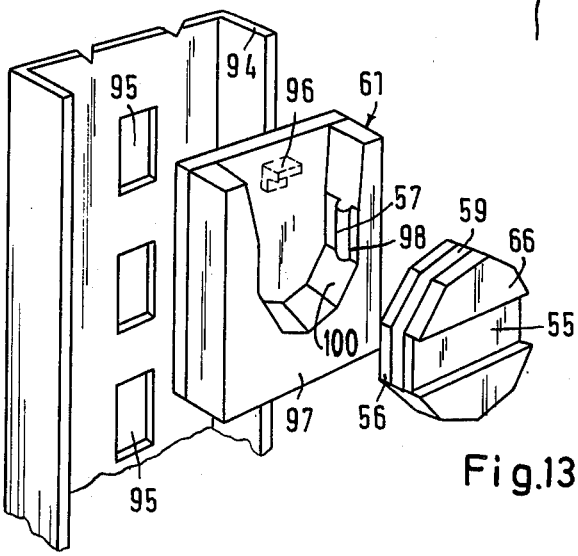
FIG. 13 shows a perspective illustration of another embodiment of the invention.

FIG. 15 and 16 show another modification of the locking device on the connection plate 61 and a corresponding modification of the edge on the carrier element. The polygon faces 98, 99 each have on their section pointing away from the front side of the connection plate 61 a step 102, 104 protruding inward which narrow the cross section of the opening of the step bearing of the bearing part 97. By way of a slanting surface 108 each of the two steps 102 and 104 goes over into the rear base section 106, 107 which borders on the front side of the connection plate 61. Although for the purpose of the invention, it is sufficient if the polygon faces 98, 99 each are provided with a step 102, 104, in the cross-sectional drawing illustrated in FIG. 15 each of the polygon faces of the step bearing is shown equipped with a corresponding step.

According to FIG. 16, the bearing element has a front polygon section 110 whose diameter is smaller and with which an edge 101, which protrudes radially over a slanting transition surface 105, is connected toward the rear. The edge 101 has an outer diameter which is slightly smaller than the inside width of the step bearing measured between the base sections 106, 107 whereas the radial extension of the front section 110 of the bearing element 66 is smaller than the inside width between the steps 102, 104 of the step bearing. When in use, the edge 101 reaches behind the steps 102, 104—with the slanting transition surface 105 bearing on the slanting surfaces 109. This form of the bearing element, too, permits an insertion in the bearing part 97 at any angle prescribed by the polygon faces. Since the bearing element 66 is only slightly thicker than the depth of the bearing part 97, this embodiment of the invention permits a practically complete utilization of the space available between opposite columns 71 for the merchandise repository 70.

Figure 20:
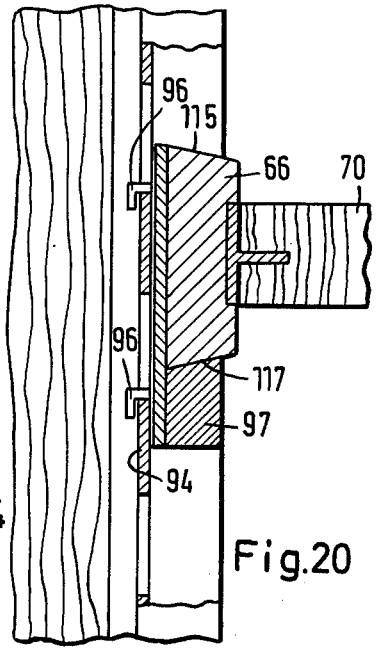
FIG. 20 shows a view of a vertical cut of another embodiment of the invention.

On the modification which can be recognized in a vertical section in FIG. 20, the axial arresting of the connection part 66 is achieved by wedge surfaces. The polygon surfaces rise uniformly toward the outside so that the slanting surfaces 108 thus extend as conical surfaces 117 over the entire depth of the polygon surfaces. The carrier element is correspondingly designed as a polygon cone with polygon surfaces 115 extending radially inward.

Figure 17:
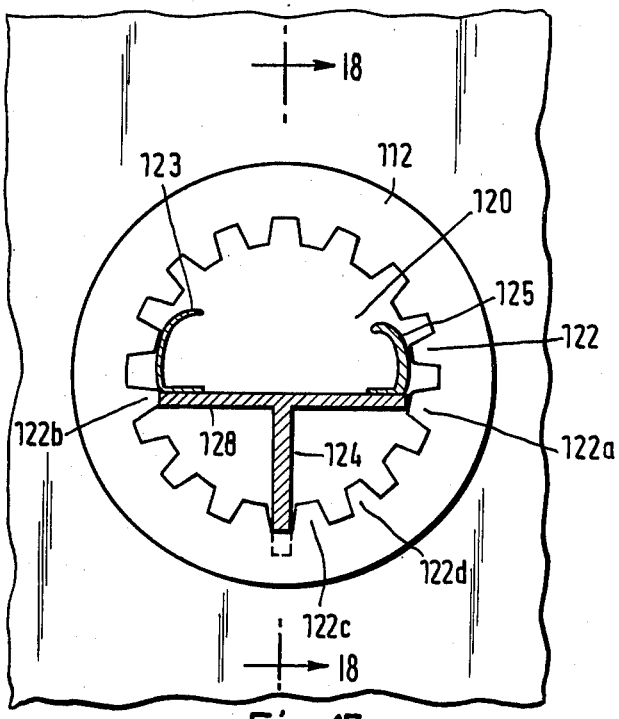
FIG. 17 shows a top view of another partly cut embodiment of the invention.
Figure 18:
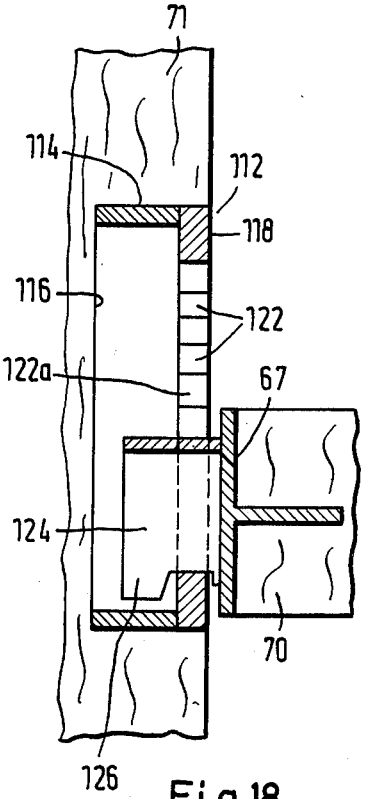
FIG. 18 shows a view of a cut of the embodiment according to FIG. 17 along line 18—18.
Figure 19:
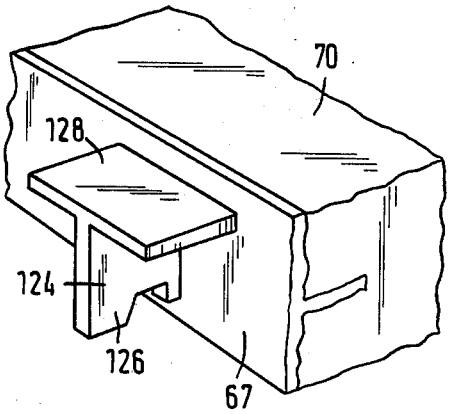
FIG. 19 shows a perspective view of the carrier element according to FIG. 17 and 18.

Special advantages are provided also by another embodiment of the invention which is shown in FIG. 17 to 19 and which—doing without the stabilizing rail—is appropriate especially for load bearing woods. According to FIG. 17 and 18, the connection plate consists of a rosette 112 which, by means of a rear outer thread ring 114, is screwed into a bore 116 of the column 71. This rosette has also a toothed front plate 118 in whose central opening 120 several teeth 122 protrude inward.

The carrier element as a suspension hook 124 stamped from flat iron is placed obtuse on the base carrier 67. Its lower end, which points away from the base carrier 67 is extended downward into a nose 126. The suspension hook has on its upper edge a crosspiece 128 which extends away from the support bracket 67 at least so far that its edge pointing away from the latter is located above the start of the formation of the nose 126. The length of the crosspiece 128 in the direction of the support bracket 67 is slightly smaller than the distance of the crowns of the two opposite teeth 122*a*, 122*b* of the toothed plate 118. When the angle of the support bracket 67 is seen from above, the carrier element 124 with the crosspiece 128 forms therewith a T which is shaded in FIG. 17.

When in use, the merchandise base 70 with the carrier element 124, which is fastened crosswise to the support bracket 67 is hung into the toothed plate so that the nose 126 reaches into the bore 116 behind the toothed plate 118. The side edges of the crosspiece 128 are then lying against the teeth 122*a*, 122*b* which are opposite each other and secure the merchandise base against tilting around the longitudinal axis. If a slant of the merchandise base 70 is desired, the carrier element 124 can be hung between other teeth, perhaps the adjacent teeth 122*c*, 122*d*.

Figure 21:
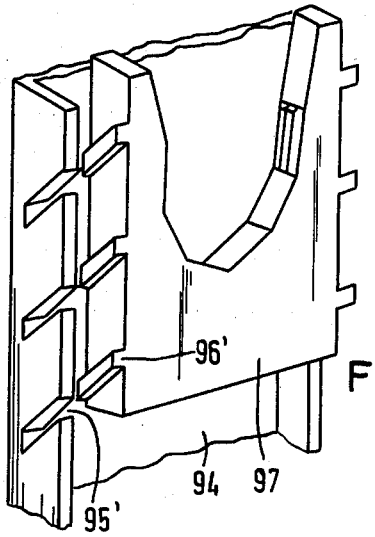
FIG. 21 shows another detail on a device as defined in the invention.

The hooks 96, which for their axial fixing are fastened on the back side of the connection plate, can in another embodiment of the invention according to FIG. 21 be replaced also by a groove and tongue connection between the side plates of the U rail 94 and the side surfaces of the connection plate 61 or of the step bearing 97, respectively. As illustrated, one side plate of the U rail 94 is provided with several cutouts 95' leading down backward and arranged one above the other at a uniform distance. On the side surface of the step bearing 97 there protrude at a uniform distance ribs 96' which in their form and slant fit the cutouts 95'.

In order to secure the carrier element additionally in the opening of the rosette-shaped connection plate 122, there can be riveted on the top side of the plate 128 on each of the two opposite sides one spring each which on the free end extends springy upward and inward (FIG. 17). Thereby a possible lateral play of the carrier element 128 between the teeth 122*a*, 122*b* is minimized and there is prevented that, when the carrier element is put in for the tilting position—thus approximately between the teeth 122*c*, 122*d*—the plate 128 of the carrier element gets hooked between the teeth. In FIG. 18, the spring 123 or 125 is omitted for the purpose of a clearer view.

Of course, it is also within the framework of the invention to make the edge 84 wider than it is shown in FIG. 7, so that then it extends further inward.

The Invention is claimed as follows:

1. Device for the detachable anchoring of a merchandise deposit base on a column, which has recesses, of an indoor furnishing system having a connection plate, which carries on the back side fastening elements engaging in the recesses and is provided on the front side with a pan-shaped support device open toward the top, and having a carrier disk with a circular outline for the merchandise deposit base which can be inserted in the support device at a selectable slant around its longitudinal axis relative to the horizontal and is secured by locking means, characterized by the fact that the carrier disk is a circular disk and that the locking means consists of at least one projection on the support device and of several recesses on the periphery of the carrier disk each of proper size for selectively receiving said projection.

2. Device as defined in claim 1, characterized by the fact that the recesses are made as bores.

3. Device as defined in claim 1, characterized by the fact that the recesses are open on the side pointing to the column and that an overlapping part holding the carrier plate axially is provided on the support device.

4. Device that depends from any of claims 1, 2 and 3, characterized by the fact that the carrier disk is, by way of a spacing element, connected with a T-support inserted in the merchandise deposit base with the spacing element forming with the T-support a groove for the engaging of the overlapping part.

5. Device for the detachable anchoring of a merchandise deposit base on a column, which has recesses, of an indoor furnishing system having a connection plate, which carries on the back side fastening elements engaging in the recesses and is provided on the front side with a pan-shaped support device open toward the top, and having a polygonal carrier plate which can be inserted in the support device at a secured selectable slant around its longitudinal axis relative to the horizontal, characterized by the fact that the support device has a radial overlapping part holding the carrier disk axially.

6. Device as defined in claim 5, characterized by the fact that the overlapping part is designed as a rib protruding radially inward and that the carrier disk has a groove running around its periphery.

7. Device as defined in claim 5, characterized by the fact that the overlapping part is designed as an outward narrowing cone of the support device and that the carrier disk has a conical periphery widening outward.

8. Device as defined in claim 5, characterized by the fact that the overlapping part has a step projecting inward on the outside and that the carrier disk has a correspondingly stepped periphery.

9. Device as defined in any of claims 5 and 6–8, characterized by the fact that the carrier disk is, by way of a spacing element, connected with a T-support inserted in the merchandise deposit base with the spacing element forming with the T-support a groove for the engaging of the overlapping part.

10. Device for the detachable anchoring of a merchandise deposit base on a column, which has recesses, of an indoor furnishing system having a connection plate, which carries on the back side fastening elements engaging in the recesses and is provided on the front side with a pan-shaped support device open toward the top, as well as having a carrying element for the merchandise deposit base that can be inserted in the support device at a selectable slant around its longitudinal axis relative to the horizontal and is secured by locking means, characterized by the fact that the connection plate has an essentially circular center opening in which several teeth protrude radially inward and that the carrying element is designed as a suspension hook having a T-shaped cross section and protruding from the side jaw of the merchandise deposit base—with the crossbar of the T forming a plate and having a width that is slightly less than the inside width of the center opening, and having on its side facing away from the merchandise deposit base a stopping nose which protrudes downward, can be hooked in behind the edge of the center opening and can be fixed between the teeth.

11. Device as defined in claim 10, characterized by the fact that on each of the two opposite ends of the plate there is placed a spring element bent inward.

12. Device as defined in claim 10, characterized by the fact that the suspension hook is placed on the outside of a T-carrier inserted into the jaw of the merchandise base.

* * * * *